US006022472A

United States Patent [19]

Herrebout et al.

[11] Patent Number: 6,022,472

[45] Date of Patent: Feb. 8, 2000

[54] STEAM CRACKING OF HYDROCARBONS IN THE PRESENCE OF THIOHYDROCARBONS

[75] Inventors: Koenraad Herrebout, Ledegem; Jacques Grootjans, Leefdaal, both of Belgium

[73] Assignee: Fina Research, S.A., Feluy, Belgium

[21] Appl. No.: 08/754,485

[22] Filed: Nov. 22, 1996

[30] Foreign Application Priority Data

Nov. 24, 1995 [EP] European Pat. Off. ..... 95118535

[51] Int. Cl.[7] ..... C10G 9/36; C07C 4/04

[52] U.S. Cl. ..... 208/130; 208/48 AA; 585/648; 585/649; 585/650; 585/652; 585/950

[58] Field of Search ..... 208/130, 48 AA; 585/648, 649, 650, 652, 950

[56] References Cited

U.S. PATENT DOCUMENTS 4,618,411 10/1986 Dickakian ..... 208/48 AA
4,619,756 10/1986 Dickakian ..... 208/48 AA

FOREIGN PATENT DOCUMENTS 210039 7/1982 Czechoslovakia .

*Primary Examiner*—Walter D. Griffin
*Attorney, Agent, or Firm*—Michael J. Caddell; William D. Jackson; M. Norwood Cheairs

[57] ABSTRACT

Sulphur-containing hydrocarbon feedstocks are desulphurized prior to being subjected to steam cracking in the presence of one or more thiohydrocarbons wherein the sulphur is part of aromatic heterocycles, preferably thiophene and/or benzothiophene. Optimum results are obtained in terms of the combination of reduced coking rate and reduced carbon monoxide formation.

4 Claims, No Drawings

STEAM CRACKING OF HYDROCARBONS IN THE PRESENCE OF THIOHYDROCARBONS

CROSS REFERENCE TO RELATED APPLICATION

This application claims priority of a pending application filed in Belgium on Nov. 24, 1995, Application Number 95118535.4 to the same inventors as the present application.

BACKGROUND OF THE INVENTION

The present invention relates to a process for the steam cracking of hydrocarbons. It also relates to an improvement in the steam cracking of hydrocarbons whereby reduced coking and carbon monoxide formation is observed.

Steam cracking of hydrocarbons is mostly used for olefins production. It is known that pyrolytic coke is formed and deposited on metal surfaces in contact with a hydrocarbon feedstock undergoing pyrolysis (i.e. high temperature thermal cracking). The consequences are (i) that the heat flux to the hydrocarbons is reduced and (ii) that the pressure drop across the reactor increases. Thus, the reactor operation has to be stopped periodically to remove the coke (said removal being usually carried out by burning the coke).

Further, the steam which is added as a diluent in steam cracking can react with the hydrocarbons in reforming reactions, catalyzed by the metal of the reactor, leading to the formation of substantial amounts of carbon monoxide. The latter is an unwanted component in the product, as it reduces the yield of valuable products and behaves as a poison towards many catalysts used in downstream reactions.

It is known that sulphur compounds inhibit said reforming reactions and thus the formation of CO, and it has therefore been proposed to add various sulphur compounds, of which dimethyldisulphide (DMDS) is most frequently used.

The feedstocks used in the steam cracking of hydrocarbons contain natural sulphur. Even with the addition of further sulphur compounds, the results were still not satisfactory in terms of the combination of reduced coking rate and reduced carbon monoxide formation.

It is thus an object of the present invention to provide a process for the steam cracking of hydrocarbons having a reduced coking rate.

Another object of the invention is to provide a process for the steam cracking of hydrocarbons yielding lower yields of carbon monoxide.

A further object of the invention is to provide a process for the steam cracking of hydrocarbons combining a reduced coking rate and lower yields of carbon monoxide.

Yet another object of the invention is to provide a process for the steam cracking of hydrocarbons while avoiding steam reforming reactions.

Still another object of the invention is to provide a process for the steam cracking of sulphur-containing hydrocarbons having one or more of the above advantages.

SUMMARY OF THE INVENTION

These and other objects are achieved by the process of the invention which comprises (i) providing a sulphur-containing hydrocarbon feedstock;

(ii) essentially removing the sulphur from the hydrocarbon feedstock to form a desulphurized hydrocarbon feedstock;

(iii) adding to the desulphurized feedstock from 10 to 1000 ppm by weight (calculated as elemental sulphur) of one or more thiohydrocarbons wherein the sulphur is part of an aromatic heterocycle, to form a sulphur-supplemented hydrocarbon feedstock;

(iv) subjecting the sulphur-supplemented feedstock to steam cracking to produce lower molecular weight hydrocarbon fractions;

(v) recovering said lower molecular weight hydrocarbon fractions.

DESCRIPTION OF THE PREFERRED EMBODIMENTS

In its broadest definition, the invention also comprises the use of desulphurized hydrocarbon feedstocks as feedstocks for steam cracking processes wherein there is added from 10 to 1000 ppm by weight (calculated as elemental sulphur) of one or more thiohydrocarbons wherein the sulphur atoms are part of aromatic heterocycles.

The hydrocarbon feedstocks for use in the invention are sulphur-containing hydrocarbon feedstocks, which for all practical purposes are hydrocarbon feedstocks naturally containing sulphur compounds.

The thiohydrocarbons are preferably selected from the group consisting of thiophene, benzothiophene and mixtures thereof.

The preferred amount of thiohydrocarbons is preferably between 20 and 400 ppmw, most preferably between 40 and 150. Typically, there is used a nominal amount of 100 ppmw, which can generally be reduced to 40 ppmw or less during operation, without losing the optimum results.

Crackers are made out of heat-resistant alloys of iron, nickel and chromium, such as Incoloy 800-HT. Those alloys are known to promote the formation and deposition of coke. Coke formation however results from complex phenomena, not yet fully understood, comprising catalytic formation, gas phase formation and growth from existing coke deposits.

The trend in industrial operation is towards increasingly severe operation conditions, namely higher operating temperatures but correspondingly shorter reaction times. The most recent techniques use temperatures of about 900° C. and residence times of about 100 milliseconds. The more the operating temperature increases the more coking becomes a problem.

The Applicants have now unexpectedly found that by prior removing essentially all sulphur that may be present in the feedstock, the addition to the desulphurized feedstock of a thiohydrocarbon wherein the sulphur is part of an aromatic heterocycle produced improved results in steam cracking (in terms of the combination of reduced coking rate and reduced carbon monoxide formation). Thiophene, benzothiophene and mixtures thereof are preferred; the best results have been obtained with thiophene, which is therefore most preferred.

Processes for the removal of sulphur from a hydrocarbon feedstock are known and need not be described herein. See, for example, U.S. Pat. No. 4,830,735.

Essentially removing the sulphur, as used herein, means removing sufficient sulphur to observe an improvement in the steam cracking. While improvements have been observed by removing sulphur compounds down to below 10 ppmw (calculated as total S), it is preferred to desulphurize down to below 1 ppmw, most preferably below 0.1 ppmw.

Steam cracking processes are also known in the art and need not be described herein.

It is often advantageous although not necessary to provide for a pretreatment of the steam cracking reactors by a mixture of steam and one or more aromatic thiohydrocarbons, prior to the introduction of the hydrocarbon feedstock.

The invention will now be described by the following examples.

EXAMPLE 1

Liquid naphtha feedstock was obtained, which had the following characteristics:

TABLE 1

| Naphtha Feedstock | | |
|---|---|---|
| density | $d_{15/4}$ | 0.6477 |
| ASTM-D86 | ° C. | IBP = 38.8<br>50 vol % = 45.9<br>FBP = 67.8 |
| n-paraffins | wt % | 51.31 |
| i-paraffins | wt % | 42.36 |
| naphthenes | wt % | 4.86 |
| aromatics | wt % | 1.45 |
| $C_5$ hydrocarbons | wt % | 59.27 |
| $C_6$ hydrocarbons | wt % | 40.02 |
| sulphur content | ppmw | 100(*) |

(*)of which sulphides: 18; disulphides: 20; mercaptans: 41; thiohydrocarbons with the sulphur in aromatic heterocycles: 21.

The sulphur-containing feedstock was desulphurized by hydrotreating it under the following conditions:

catalyst: KF 742 from AKZO-NOBEL (4.2 % wt CoO, 15 wt % $MoO_3$)

temperature: 250° C.

pressure: 4 MPa (gauge)

liquid hourly space velocity (LHSV) : 5.0 L/L.h hydrogen/hydrocarbon: 80 NL/L (wherein N means normal) in once-through.

The desulphurized feedstock contained less than 0.1 ppmw of sulphur.

The deeply desulphurized liquid naphtha (wherein sulphur was undetectable) and water for the dilution steam are each fed to the reactor by means of electronically-controlled pulsation-free pumps; the flow rate of water was set at half of the flow rate of naphtha (both by weight). Thiophene was continuously added to the feed at a level of 100 ppmw (calculated as S).

The steam cracking reactor is a tube having an internal diameter of 1 cm and a length of 10703 mm, made of the Fe-Ni-Cr alloy known as Incoloy 800-HT. The reactor is placed in a brick furnace fired by means of gas burners mounted in the furnace. The furnace is divided into separate cells which can be fired independently. The gas burners in each cell are controlled in such a way as to provide a temperature profile similar to an industrial one. Temperatures along the reactor were recorded at the following locations:

T1—after 1114 mm

T2—after 2240 mm

T3—after 5061 mm

T4—after 7882 mm

T5—at the outlet (i.e. after 10703 mm)

The actual steam cracking experiment was preceded by a presulphiding step of the steam cracking reactor, in which steam containing 100 ppmw thiophene was passed during 2 hours at a rate of 2.4 kg/h with the following temperature profile:

TABLE 2

| | Start | Gradient | End |
|---|---|---|---|
| T1 | 380° C. | — | 380° C. |
| T2 | 450° C. | — | 450° C. |
| T3 | 520° C. | 6° C./min | 575° C. |
| T4 | 600° C. | 6° C./min | 834° C. |
| T5 | 600° C. | 6° C./min | 890° C. |

During the actual steam cracking, the temperature conditions were as indicated in Table 2 in column "end". The other process conditions were:

TABLE 3

| | |
|---|---|
| total hydrocarbon flow rate | 4.8 kg/h |
| total steam flow rate | 2.4 kg/h |
| residence time | 100 ms above 575° C. |
| outlet pressure | 0.07 MPa (gauge) |

After about 20 minutes, the experimental conditions were stabilized. Effluent analyses were made at regular intervals, more particularly to monitor CO formation. A run length of 6 hours was used.

Coke formation in the reactor is determined indirectly by integrating the amounts of CO and $CO_2$ formed during a decoking step (i.e. by burning any coke formed).

The results were the following. No carbon monoxide was detected during steam cracking under stable conditions (the detection limit being 50 ppmw). Coke formation was of 4.47 g after 6 hours.

EXAMPLE 2

It is known in the art that the coke formed by steam cracking is the result of catalytic coke formation and asymptotic coke formation. Since the former is limited over time, the latter is an important factor in the total run length of an industrial furnace.

Accordingly, a twelve-hours run was performed under the otherwise unchanged conditions of Example 1. As catalytic coke formation had finished after about one hour, the asymptotic coke formation could be calculated by difference.

TABLE 4

| | Ex. 2 (12 hours) | Ex. 1 (6 hours) |
|---|---|---|
| coke formation (g) | 7.33 | 4.47 |

Thus, the asymptotic coke formation rate was of 0.48 g/h (which is equivalent to 2.92 g/h.$m^2$). The pressure drop increase attributable to asymptotic coke formation was of 0.1 kPa/h.

EXAMPLE 3 (comparative)

Example 1 was repeated while omitting the desulphurization step. Thiohydrocarbons with S in aromatic heterocycles were present at a level of 21 ppmw (calculated as S), while there was a total of 100 ppmw of S in the feed stock sent to the steam cracker.

No carbon monoxide was detected during stable steam cracking operation. After 6 hours of stable steam cracking operation, there was formed a total of 11.15 g coke.

EXAMPLE 4 (comparative)

Example 3 was repeated with an additional 79 ppmw thiophene (calculated as S) added to the feedstock sent to the steam cracker, so that the total content of thiohydrocarbons with S in aromatic heterocycles was 100 ppmw and the total S content was 180 ppmw.

There was produced more coke than in example 3.

EXAMPLE 5 (comparative)

Example 1 was repeated without any thiophene addition after desulphurization.

During stable steam cracking operation, the effluent contained 2.45 vol % of CO.

After 6 hours of stable steam cracking operation, there was formed a total of 1.27 g coke.

EXAMPLES 6 AND 7 (comparative)

Examples 1 and 2 were repeated, while replacing thiophene by dimethyldisulphide (DMDS) which is the sulphur compound presently used in industrial operation. The results were as follows:

TABLE 5

| | Ex. 6 | Ex. 7 |
|---|---|---|
| CO (vol %) | 0 | 0 |
| coke | 9.35 | 15.38 |

Thus, the asymptotic coke formation rate was of 1 g/h (equivalent to 6.16 g/h $m^2$) and the pressure drop increase attributable to asymptotic coke formation was of 0.15 kPa/h.

EXAMPLE 8

Propane containing 10 ppmw of sulphur, essentially as $H_2S$ and $CH_3SH$, was desulphurized by passing it over an absorbent material prepared and conditioned as described in example I (under a and b) of U.S. Pat. No. 4,830,735, at a temperature of 30° C., under a pressure of 2.5 MPa and with a LHSV of 5 L/L.h. The desulphurized propane contained less than 0.1 ppmw of sulphur.

The desulphurized propane was then subjected to steam cracking under the conditions described in example 1 hereabove except that the outlet temperature was of 920° C. and the amount of thiophene added was of 200 ppmw.

No carbon monoxide was detected in the effluent. There was formed 27 g of coke.

EXAMPLE 9 (comparative)

Example 8 was repeated while replacing thiophene by DMDS. No carbon monoxide was detected in the effluent, and there was formed 61 g of coke.

EXAMPLE 10 (comparative)

Example 8 was repeated while omitting the desulphurization step. The effluent contained 1.59 % of carbon monoxide, and there was formed 2 g of coke.

We claim:

1. A process for the steam cracking of hydrocarbons, comprising the steps of:

(i) providing a sulphur-containing hydrocarbon feedstock;

(ii) removing the sulphur from the hydrocarbon feedstock to form a desulphurized hydrocarbon feedstock;

(iii) adding to the desulphurized feedstock from 10 to 1000 ppm by weight (calculated as elemental sulphur) of at least one thiohydrocarbon wherein the sulphur is part of aromatic heterocycles, to form a sulphur-supplemented hydrocarbon feedstock;

(iv) subjecting the sulphur-supplemented feedstock to steam cracking to produce lower molecular weight hydrocarbon fractions; and, (v) recovering said lower molecular weight hydrocarbon fractions.

2. The process according to claim 1, wherein said at least one thiohydrocarbon is selected from the group consisting of thiophene, benzothiophene and mixtures thereof.

3. The process according to claim 1, wherein there is added from 20 to 400 ppmw of said thiohydrocarbons.

4. The process according to claim 3, wherein there is added from 40 to 150 ppmw of said thiohydrocarbons.

* * * * *